US006132318A

United States Patent [19]

Briggs

[11] Patent Number: 6,132,318

[45] Date of Patent: Oct. 17, 2000

[54] INTERACTIVE FUNHOUSE PLAY STRUCTURE

[75] Inventor: Rick A. Briggs, Springfield, Ill.

[73] Assignee: SCS Interactive, Inc., Springfield, Ill.

[21] Appl. No.: 09/033,528

[22] Filed: Mar. 2, 1998

Related U.S. Application Data

[60] Provisional application No. 60/052,755, Jul. 1, 1997, abandoned.

[51] Int. Cl.[7] ..... A63G 31/00

[52] U.S. Cl. ..... 472/128

[58] Field of Search ..... 472/117, 128; 482/35; 239/209; 273/395

[56] References Cited

U.S. PATENT DOCUMENTS 5,135,440 8/1992 Smollar et al. ..... 472/128
5,649,867 7/1997 Briggs .
5,662,525 9/1997 Briggs .
5,673,918 10/1997 Bigari .
5,741,189 4/1998 Briggs .
5,820,471 10/1998 Briggs .
5,820,472 10/1998 Briggs .

*Primary Examiner*—Kien T. Nguyen
*Attorney, Agent, or Firm*—Knobbe Martens Olson & Bear, LLP

[57] ABSTRACT

An interactive play structure is provided comprising a path defined by the structure along which a plurality of play effects are disposed. As play participants work their way through the structure, they are doused by various water, air and other effects controlled by other play participants. As they continue along the path, participants may discover the controls of these effects and actuate them to douse others.

22 Claims, 13 Drawing Sheets

FIG. 6K
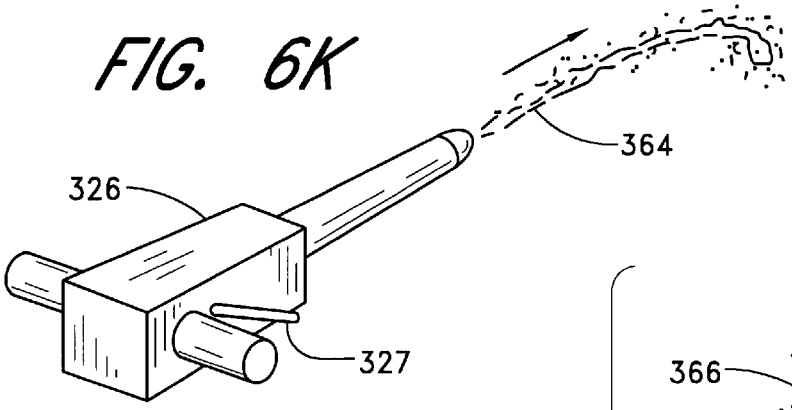
FIG. 6L
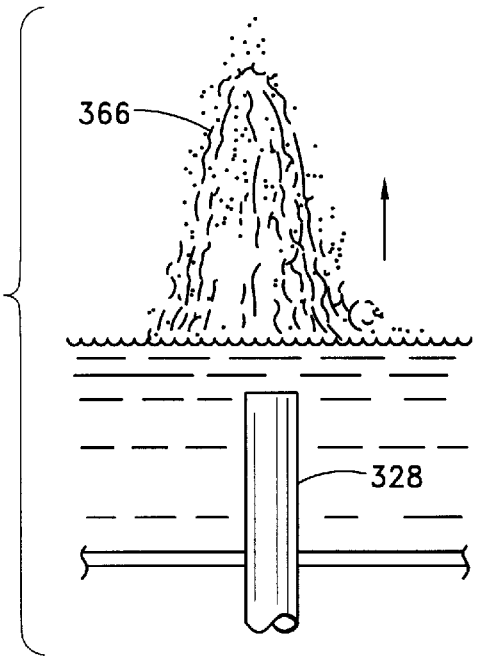
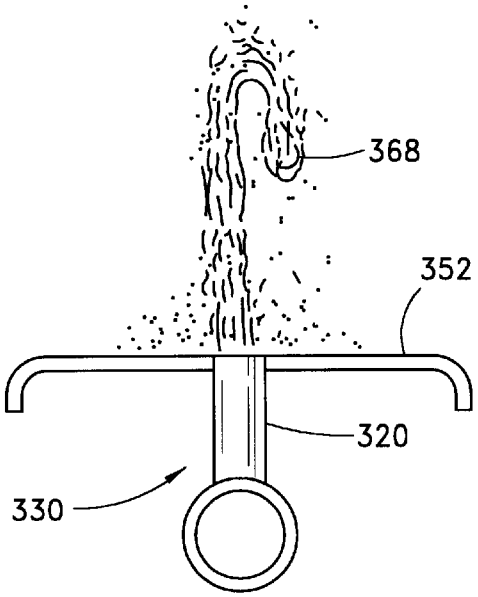
FIG. 6M
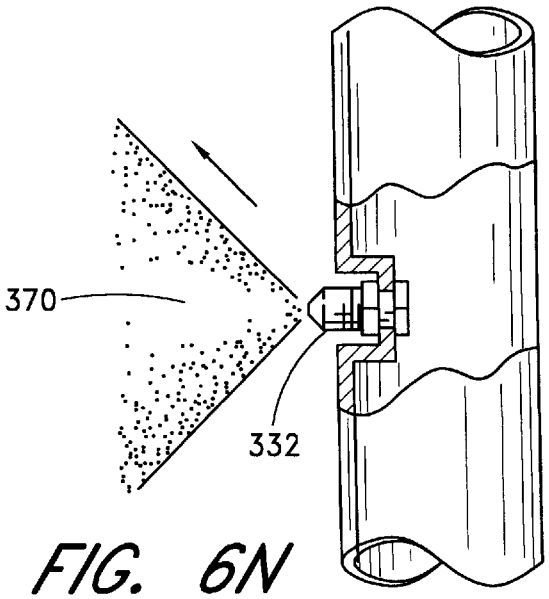
FIG. 6N

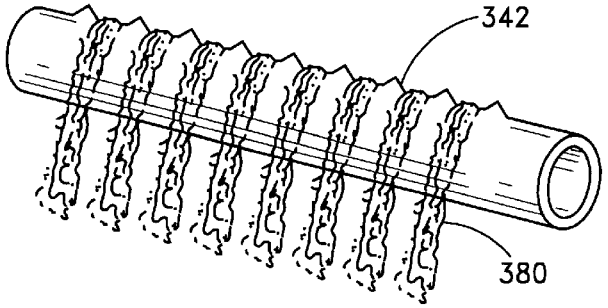
FIG. 6S
FIG. 6T
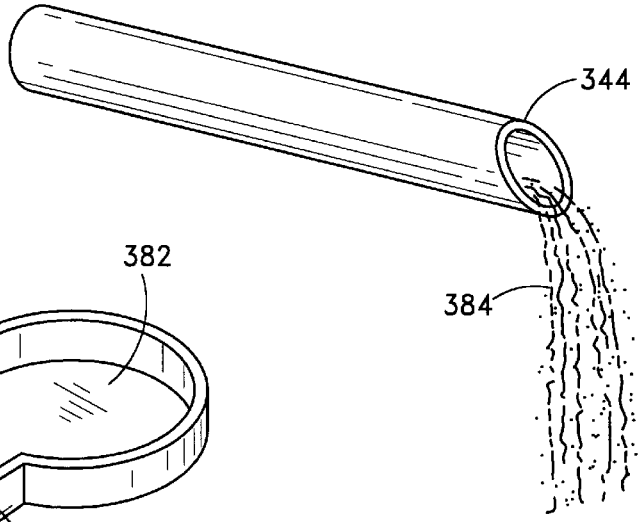
FIG. 6U
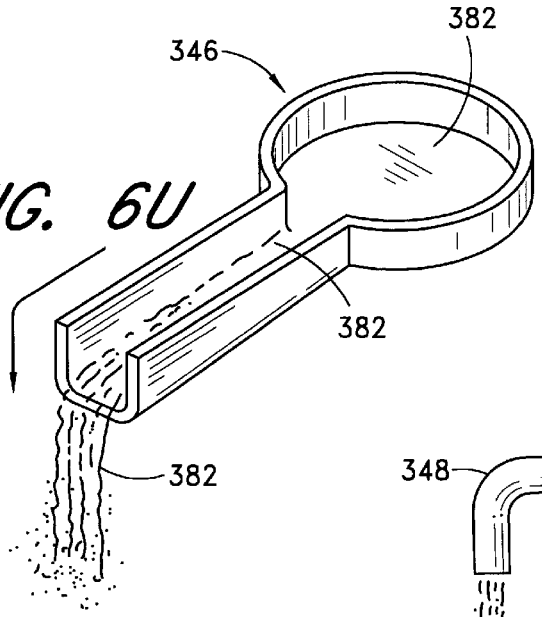
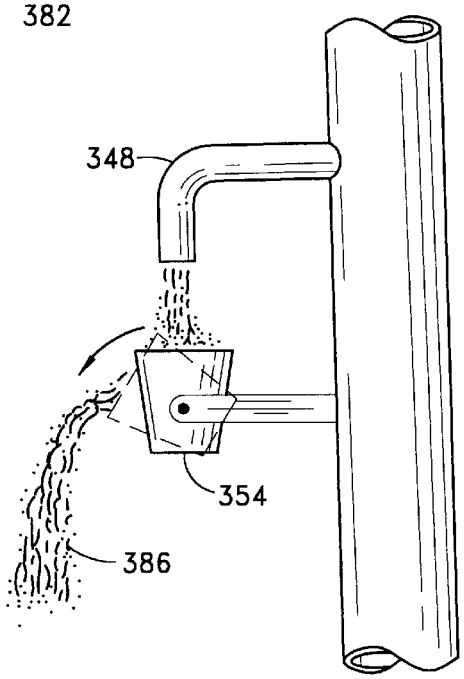
FIG. 6V

INTERACTIVE FUNHOUSE PLAY STRUCTURE

RELATED APPLICATIONS

This application claims priority to U.S. Provisional Application Ser. No. 60/052,755; filed on Jul. 1, 1997 now abandoned.

BACKGROUND OF THE INVENTION

1. Field of the Invention

The present invention relates to interactive play structures and, in particular, to an interactive funhouse play structure for entertaining and educating children and adults.

2. Description of the Related Art

For years, carnival funhouses have entertained young and old alike. The typical funhouse is a structure where participants work their way through a defined path of hallways or passageways containing various amusement effects. Dramatic graphics, collapsing stairs and, of course, a hall of mirrors are all part of the typical funhouse experience.

Other path-oriented play structures are known which allow participants to work their way through a maze or path containing various amusement effects. An example is a haunted house. Participants work their way through the house, experiencing various "haunting" effects along the way. Other structures in the shapes of castles or forts are known which allow participants to work their way through the structure and observe interesting displays or stories.

However, these structures are typically not interactive. Rather, play participants are guided through a defined path or maze while passively observing or experiencing various amusement effects. Thus, the entire experience remains largely passive.

SUMMARY OF THE INVENTION

It would be desirable to provide a funhouse play structure or other pathoriented play structure which provides an interactive play experience and which incorporates a wide range of play media and mechanisms such as balls, air and water effects, valves, pulleys, baskets, buckets and the like to create a path-oriented interactive funhouse experience.

My U.S. Pat. No. 5,194,048 first disclosed the concept of a participatory water play apparatus which enabled children and adults to observe and experiment with various cause-and-effect reactions involving water. The present invention expands and improves upon this basic concept by combining the stimulating interaction of a participatory play structure with the adventure and excitement of a path-oriented play structure. The present invention also provides a single play structure in which an entire family can participate and interact with one another and in which participants can take turns surprising or being surprised by the various play effects.

In accordance with one embodiment of the present invention, an interactive funhouse play structure is provided wherein participants work their way along a path through the structure and interact with various play effects and other play participants making their way along the same or a different path. The play structure includes a number of play elements disposed at various locations and elevations throughout the play structure. Each play element can be activated or operated by one or more play participants to produce a desired effect. Participants can play dual roles. At times, a participant may operate a play element that has the effect of sending a surprising douse of water or an air blast onto another play participant. In turn, that participant will sometimes find himself on the receiving end of such a surprise attack.

In accordance with another embodiment of the present invention, a participatory water play structure is provided for entertaining many participants simultaneously. The structure combines the stimulating interactive aspects of a water play structure with the adventure and excitement of a funhouse to exploit the best qualities of both and to create a new world of exciting interactive play. Play participants work their way through a funhouse structure with water effects that they can control. These may include such effects as gag boxes, bubbling floor jets and sprays, geysers, air blasts, dumping buckets, one-way mirrors, overhead spouts and funnels and other fun and exciting effects.

In accordance with another embodiment of the present invention, an exciting new play effect is provided in the shape of a giant simulated boiler or pressure vessel. The boiler includes a "pressure gauge." As time passes, the pressure gauge registers increasing pressure. As pressure rises, "leaks" appear in the form of streams of water proceeding from the boiler. Eventually, the boiler will whistle and "burst," sending mountains of water in all directions and creating water play effects such as water spraying out of a clown's nose. This creates dramatic visual and sound effects for surprising, entertaining and amusing play participants. After each burst, the cycle repeats at regular or irregular intervals.

BRIEF DESCRIPTION OF THE DRAWINGS

FIG. 6*k* shows a water gun forming a water gun jet;

FIG. 6*l* shows a geyser nozzle forming a geyser;

FIG. 6*m* shows a platform nozzle forming a platform spout;

FIG. 6*n* shows a mist nozzle issuing a mist water effect;

FIG. 6*s* shows a rake water fall weir forming a rake water fall;

FIG. 6*t* shows an open pipe aperture forming a non-pressurized gravity pour water effect;

FIG. 6*u* shows a pool and runnel aperture making a pond/stream/fall combo water effect;

FIG. 6*v* shows a bucket aperture making a bucket dump water effect;

DETAILED DESCRIPTION OF THE PREFERRED EMBODIMENTS

Fundamentally, the present invention comprises an interactive play structure having and entrance and an exit in which participants can work their way along a path through the structure. Various play effects are disposed along the way, some apparent, some hidden. Participants are able to activate play elements that control these effects. Some of the play elements, when activated, correspond to play effects that may startle other play participants with a dousing of water or an air blast. Participants have the opportunity to activate play elements whose effects will surprisingly douse others. Some play elements may have immediate results. Others may have delayed results. Some effects may be local, while others may be remote. Each play participant, or sometimes a group of play participants working together, must experiment with the various play elements in order to discover which ones operated in which sequence will create the desired effect. Once one group figures it out, they can use the resulting effect to surprise and entertain other play participants working their way along the path. Yet other play participants will observe the effect and will attempt to also figure it out in order to turn the tables on the next group. The result is an endlessly entertaining and educational adventure for the whole family.

The play effects may utilize water, air or a variety of other fun play mediums, as desired. Other suitable interactive play media may include a wide diversity of items such as, for example, tennis balls, plastic or rubber balls, beach balls, balloon balls, styrofoam particles, frisbees, hoola-hoops, foam balls/darts/arrows, snow, mud, water-balloons, slime, as well as a variety of other fun and exciting play media well known to those skilled in the art.

Figure 1:
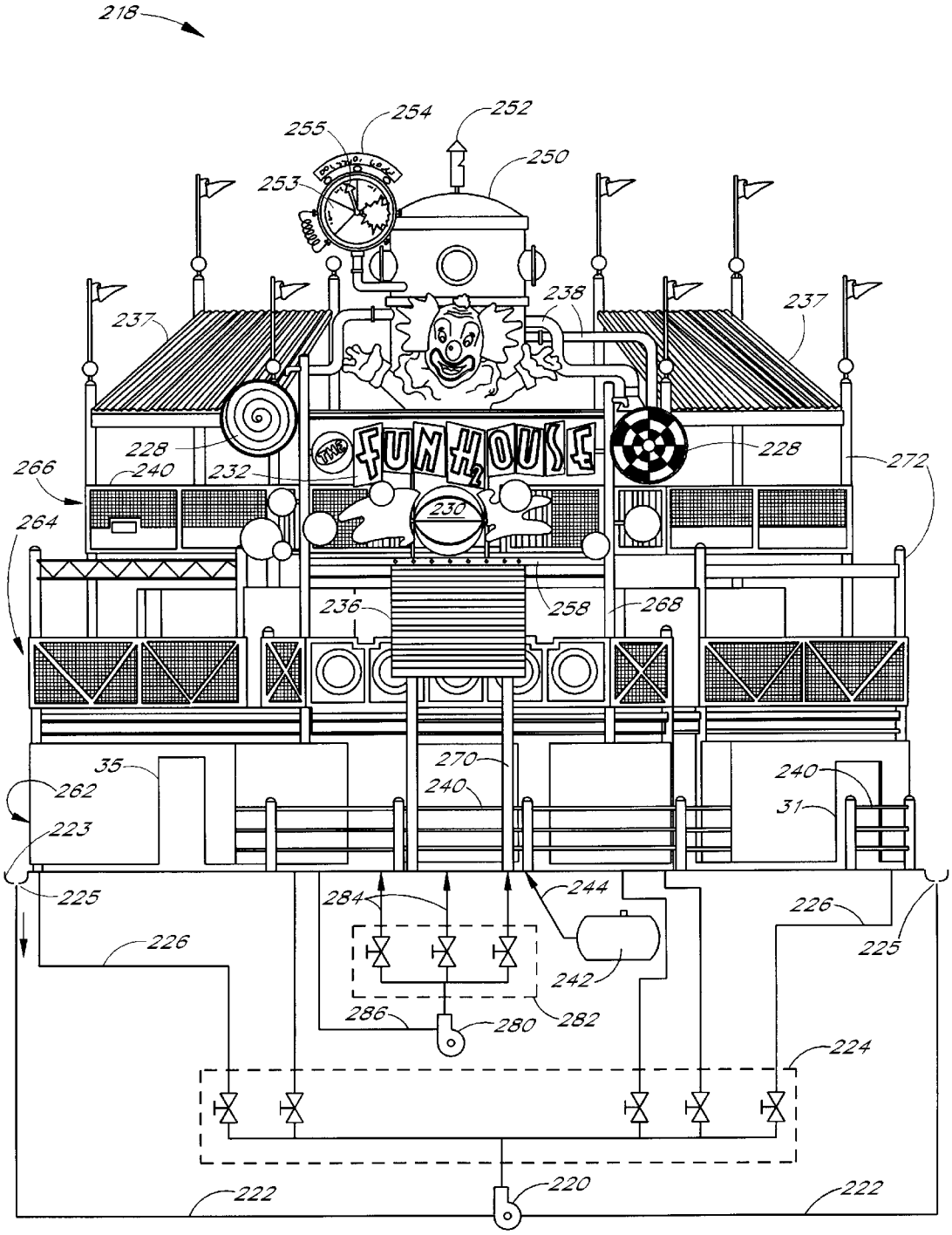
FIG. 1 is a front elevational view and schematic plumbing diagram of a preferred embodiment of a path-oriented interactive funhouse play structure having features of the present invention.

FIG. 1 is a front elevational view and schematic plumbing diagram of one preferred embodiment of a path-oriented interactive play structure having features of the present invention. This particular structure is provided in the theme of a carnival funhouse, as shown. Of course, those skilled in the art will readily appreciate that the path-oriented interactive play structure of the present invention is not limited to this one preferred embodiment, but may be implemented in accordance with a wide variety of other possible exciting play themes. For example, a haunted house, medieval castle, fort, dungeon, caves, mine, power plant, factory or even a rock slide can provide exciting play themes for accommodating a path-oriented interactive play structure having benefits and advantages as taught by the present invention.

Preferably, the play system comprises an integrated play structure 218 having multiple levels and/or platforms 262, 264, 266 that contain an assortment of play elements that play participants can operate as they work their way through the structure. For example, the play structure 218 may incorporate a variety of participatory water play elements and non-water play elements spaced every few feet.

Support for the play structure 218 is provided by a supporting framework 272 comprising primarily water carrying conduits 268 and non-water carrying framing elements 270. Conduits 268 are preferably selected to be of sufficient size and strength to safely support the play structure 218 and play participants while also supplying water to the various interconnected water play elements.

Preferably, the conduits 268 are formed from hollow steel pipes that are adapted to be bolted or welded together using commercially available pipe fittings. Standard Schedule 40 galvanized steel pipe having an outside diameter of between about 4 and 8 inches and a wall thickness of between about ⅛ and ½ inches should be suitable for most applications. Alternatively, some or all of the conduits 268 may be formed from other suitable materials such as PVC pipe, copper pipe or clay/ceramic pipe, as desired.

Framing elements 270 are selected to safely support non-water play elements and/or to provided additional support for roofing and other optional structures, as desired. Framing elements 270 may be constructed of any convenient material having adequate strength, durability and resistance to corrosion. Aluminum or wood framing elements, galvanized structural steel, PVC pipe or any other corrosion-resistant material may be used, as desired, to provide additional support for the play structure 218 and play participants.

It will be apparent to those skilled in the art that a variety of other possible framing designs may be used for constructing the supporting framework 272. For instance, supporting framework 272 may be constructed substantially entirely of nonwater water carrying framing elements 270. In that event, water may be provided to the various water effects by separate plumbing conduits (not shown) that are either external or internal to the framing elements 270. It is preferred, however, that water carrying conduits 268 be used for forming substantial portions of the supporting framework 272 in order to reduce material costs and to provide fast and easy construction.

For visual appeal and added safety, optional decorative panels and/or roofing elements may be provided, as desired, to complement the particular desired theme of the interactive play system, to shade play participants from the sun or to prevent play participants from falling off the play structure 218. For instance, in the interactive funhouse embodiment shown, railings 240, corrugated roofs 236, 237, clown head graphics 234 and rotating lettering 232 are provided to complement the theme of a carnival funhouse and/or for added safety. These components may be made from wood, fiberglass, steel, reinforced fabric, PVC or other corrosion-resistant materials, as desired. Those skilled in the art will readily appreciate that a wide variety of other decorative or thematic elements may be incorporated into the overall design in order to provide added safety or convey a particular desired play theme.

As indicated in the schematic plumbing diagram, water under pressure is provided to the various supporting conduits 268 by a system of subterranean plumbing conduits running underneath the play structure. A pool or basin 223 may be provided underneath or adjacent the play structure 218 for collecting any water runoff. Drains 225 may be located at various locations around the play structure 218 in order to collect the run-off water. The precise number and location of drains 225 may be varied, as desired, according to the size of the play structure 218, the amount of water used and the contour of the underlying terrain.

It will be appreciated that run-off water flows into the various drains 225, through the collection lines 222 to the inlet port of a main recirculation pump 220. Those skilled in the art will appreciate that the main pump 220 may comprise any one of a number of commercially available pumps for pumping or recirculating water. An end-suction centrifugal or vertical turbine type pump having a capacity of between about 1500 and 2500 gpm and a maximum head of between about 40 and 50 feet of water should be sufficient for most applications.

The main pump 220 supplies the recirculated water at a predetermined head to a master control valve manifold 224, as shown. The manifold 224 is adapted to safely deliver the returned water via supply conduits 226 to each of the vertical support conduits 268. Those skilled in the art will readily appreciate that the above construction provides safe and efficient reuse of water. This is desirable because, among other reasons, it reduces operating costs, promotes water conservation and avoids possibly damaging runoff water.

Some effects in the preferred embodiment may use colored water or other liquids. This may be accomplished by the use of another suitable pump 280. Similar to the main pump 220, this secondary pump 280 supplies water to a control valve manifold 282, from which water is delivered to the appropriate water effects via supply conduits 284. A pump having a capacity of about 300 gpm and a maximum head of about 30 feet of water should be sufficient. Those skilled in the art will realize that as the use of colored water or other liquids becomes more extensive, a larger-capacity pump will be required. To prevent mixing of the colored water or other liquid with water in the other portions of the play structure, play effects using colored liquid are preferably separated from other play effects. The colored liquid play effects may also preferably have their own liquid retrieval systems. In the preferred embodiment shown, the colored liquid play effects drain into a pool from which the pump draws the colored liquid.

The vertical support conduits 268 provide water under pressure to a variety of interconnected water forming devices and water play elements. As used herein, the term "water forming device" refers to a nozzle or other device from which water may be caused to issue. The term "water play element" refers to any play element that uses water and that may be manipulated or controlled by one or more play participants to create a desired water play effect, such as spraying, spilling, bubbling, pouring, or splashing water.

Preferably, an air compressor 242 provides air under pressure which is routed through the structure via air lines 244 as needed for various air effects within the structure. These air effects may include, for example, air jets, air curtains or a whistle 252. A single 10–25 horsepower air compressor 242 that can provide air in the range of 35–100 cfm at a line pressure of about 10–100 psi should be adequate for most purposes.

Figure 2:
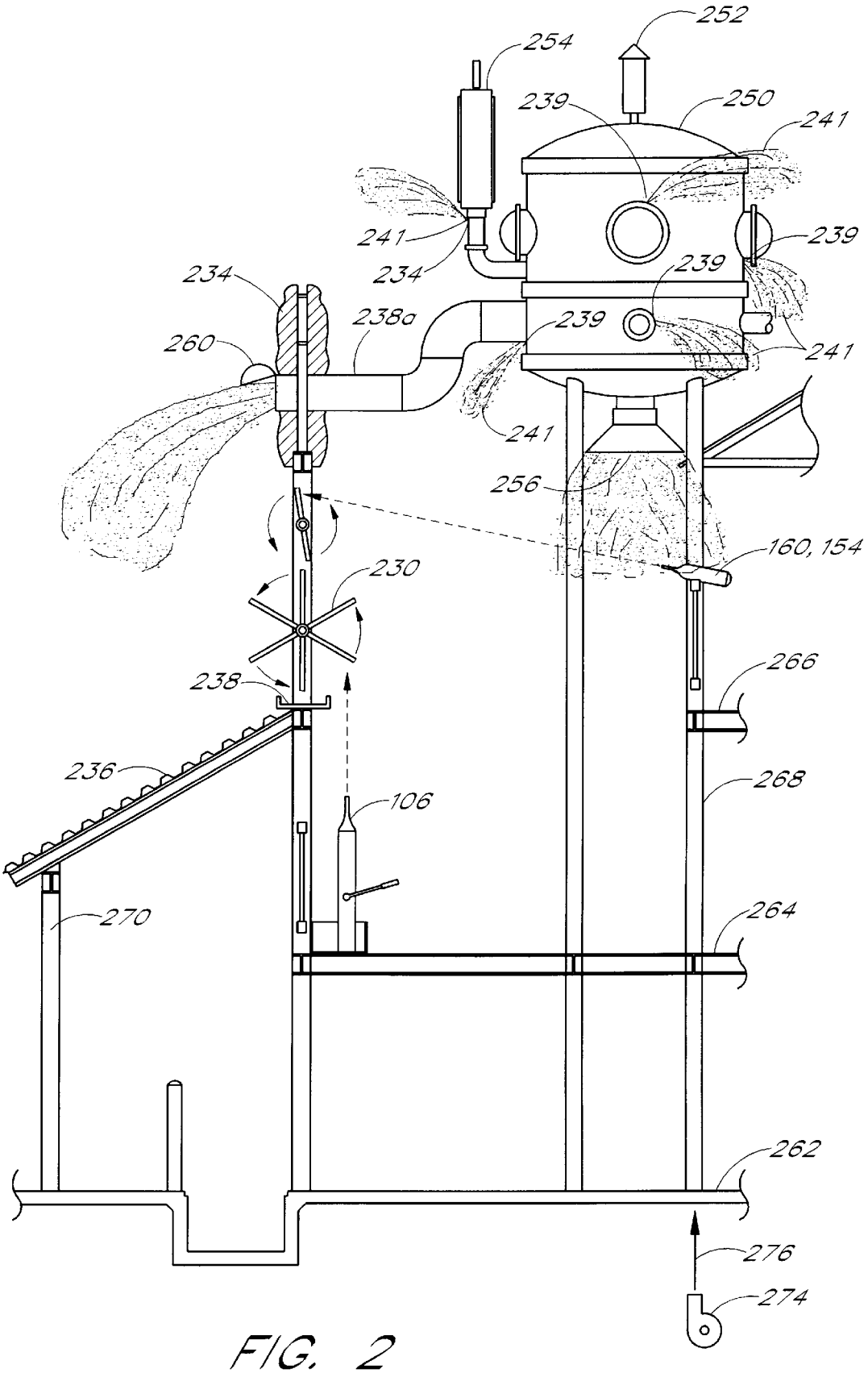
FIG. 2 is a side elevational view of the interactive water play structure of FIG. 1, showing a side perspective view of a participatory water play element in the form of a giant bursting pressure vessel.

FIG. 2 shows a dominant feature of the path-oriented interactive water play structure of FIG. 1 in the form of a giant play boiler 250. The boiler 250 is mounted at the top of the structure and operates as a delayed or synchronized water effect which periodically showers thousands of gallons of water on the play participants below, creating dramatic visual and sound effects. Anticipation mounts as the "pressure" builds in the boiler 250 over time. As the pressure builds, "leaks" 241 begin appearing in the form of water spraying out of various parts of the boiler 250. Eventually, the pressure gets too high, the whistle 252 blows, and the boiler 250 "bursts," dumping thousands of gallons of water on participants below through an assortment of pipes 238 and showers 256. Various sound or vibration effects can be added, as desired, to enhance the overall effect. After the burst, the cycle restarts. FIG. 1 provides alternate views of part of the network of pipes 238 that carry water from the boiler 250 during a burst. A "pressure gauge" 254 adds to the excitement as participants anticipate the boiler 250 getting closer and closer to bursting.

Preferably, the boiler 250 is mounted at or near the top of the play structure 218. Water for the dousing effect is supplied through pipes within the structure. As the "pressure" builds, valves are successively opened and water is pumped through nozzles 239 placed at various locations on the boiler 250. This creates a water effect of popping leaks 241 in the boiler. Successively more leaks 241 appear on the boiler 250 as the pressure increases. When the boiler 250 eventually "bursts," all valves are opened and water gushes out of many pipes and openings. A valve is also actuated in the air lines causing the whistle 252 to blow. A pipe network 238 carries large amounts of water to various parts of the structure, where it is dumped on participants.

FIGS. 1 and 2 both show views of the large pipe network 238 comprising the play structure 218. A 12" pipe 238*a* carries water to the front of the structure 218 where it spurts out of the clown head graphic 234, lifting the clown's nose 260 in the process. A shower nozzle 256 dumps water on participants below. Solenoid valves may be used to automatically control this effect. Preferably, a dedicated pump 274 is used solely for this bursting effect. This pump 274 preferably has 3000–5000 gpm and a maximum head of at least 50 feet of water. While various sizes of boiler 250 and various amounts of water may be used to create this dramatic effect, a boiler 250 having a preferred height of between about 10 and 50 feet and a preferred water use of between about 1000–3000 gallons should provide adequate results for most applications.

In the present embodiment, the bursting effect is timed to last about 30 seconds and to repeat about every 10 minutes. However, there are many options for timing and triggering of the effect. One embodiment would be to build the "pressure" and burst the boiler 250 in unpredictable intervals rather than timed cycles. Multiple boilers 250 may also be used with teams of play participants competing to build pressure first and burst the boiler 250 on their competitors.

Another alternative embodiment envisions a delayed water effect where play participants cooperate using pumps or other media to build or relieve the "pressure" and thus induce or prevent a burst. For example, a "control panel" may be provided adjacent the boiler 250 and having a complex system of lights, indicators, and buttons. As the pressure in the boiler 250 builds, indicators on the control panel may flash or otherwise instruct play participants to hit certain buttons or throw certain levers to relieve the pressure. Play participants would then be challenged to quickly read and interpret the various indicators and actuate the correct button(s) or lever(s) to reduce the pressure in the boiler 250. Those skilled in the art will appreciate the boundless possibilities for implementing this concept successfully in a wide variety of themed embodiments.

An optional "pressure gauge" 254 may be located adjacent the boiler 250 to indicate the "pressure" building in the boiler 250. This pressure gauge 254 is best shown in FIG. 1. The face 253 of the pressure gauge 254 has four sections, labeled "LOW," "MED," "HI" and "WATCH OUT." The hand 255 of the pressure gauge 254 rotates across the face 253 from the "LOW" position across "MED" and "HI" until it reaches "WATCH OUT," at which point a burst is triggered.

The pressure gauge 254 adds to the excitement of the giant boiler 250 bursting effect because play participants quickly learn to watch the pressure gauge 254 in order to predict when the boiler 250 will eventually burst. Participants can then decide whether to seek cover or possibly expose themselves to the downpour of water bursting from the boiler 250. Those skilled in the art will readily appreciate that a wide variety of other indicators, or even sound or vibration, may be used to further enhance the overall play experience in accordance with the present invention.

In the preferred embodiment shown, the pressure gauge 254 is not a true pressure gauge, but is a timer, signalling the different stages of the effect and when the burst is going to occur. In alternative embodiments, especially embodiments where participants cooperate to increase or relieve "pressure," the pressure gauge 254 could comprise an actual measuring or sensing device. For instance, play participants could build pressure in a vessel by using pumps to pump water into a bucket or other container. They could release pressure by opening valves, causing water to empty out of the container. A water level indicator connected to the container could be labeled "pressure gauge." When the container's water level reaches a prescribed point, the bursting effect could be triggered. Alternatively, the pressure gauge 254 could even function as a true gauge of pressure. Participants could use air pumps to build up pressure in an adjacent reservoir. Again, when the pressure in the gauge reaches a prescribed point, the bursting effect could be triggered.

The water that shoots from behind the clown's nose 260 during a burst preferably falls onto a deflection shield 236, causing the water to splash and disperse widely. This is primarily a safety measure to mitigate the direct impact of the water on play participants. However, the impact of the water on the deflection shield 236 also creates dramatic visual and sound effects. These can be varied by changing the shape of the deflection shield 236, its angle of orientation, and the particular materials used to construct it.

Preferably, the deflection shield 236 is constructed of a heavy-duty corrugated material, such as galvanized steel, aluminum, or fiberglass, in order to support the weight of the impacting water and to thoroughly disperse the water. Similar desirable effects may be achieved using wood or fiberglass slats, as desired. Adequate dispersion and sound effects have been achieved using corrugated 18–26 gauge galvanized steel and, more preferably, 20 gauge galvanized steel, with the corrugated folds running transverse to the water flow. Mounting the deflection shield 236 with a downward slope of between about 30 and 45 degrees provides further dispersion of water. Alternatively, a curved convex or concave deflection shield can also be used, as desired, to create various desired water effects.

Those skilled in the art will appreciate that this "leak-to-burst" effect could be accomplished using themes other than just a boiler. For example, an alternative embodiment of this effect could comprise an earthen, rock, or cement dam which springs leaks as the water level rises and eventually bursts, pouring water on the participants below. A similar "leak-to-burst" effect may also be achieved using the theme of a large water tank, vat or even the core of a nuclear reactor. Such a vat could purport to contain any type of liquid in accordance with the theme of the structure, but would actually dump clear or colored water.

Figure 3:
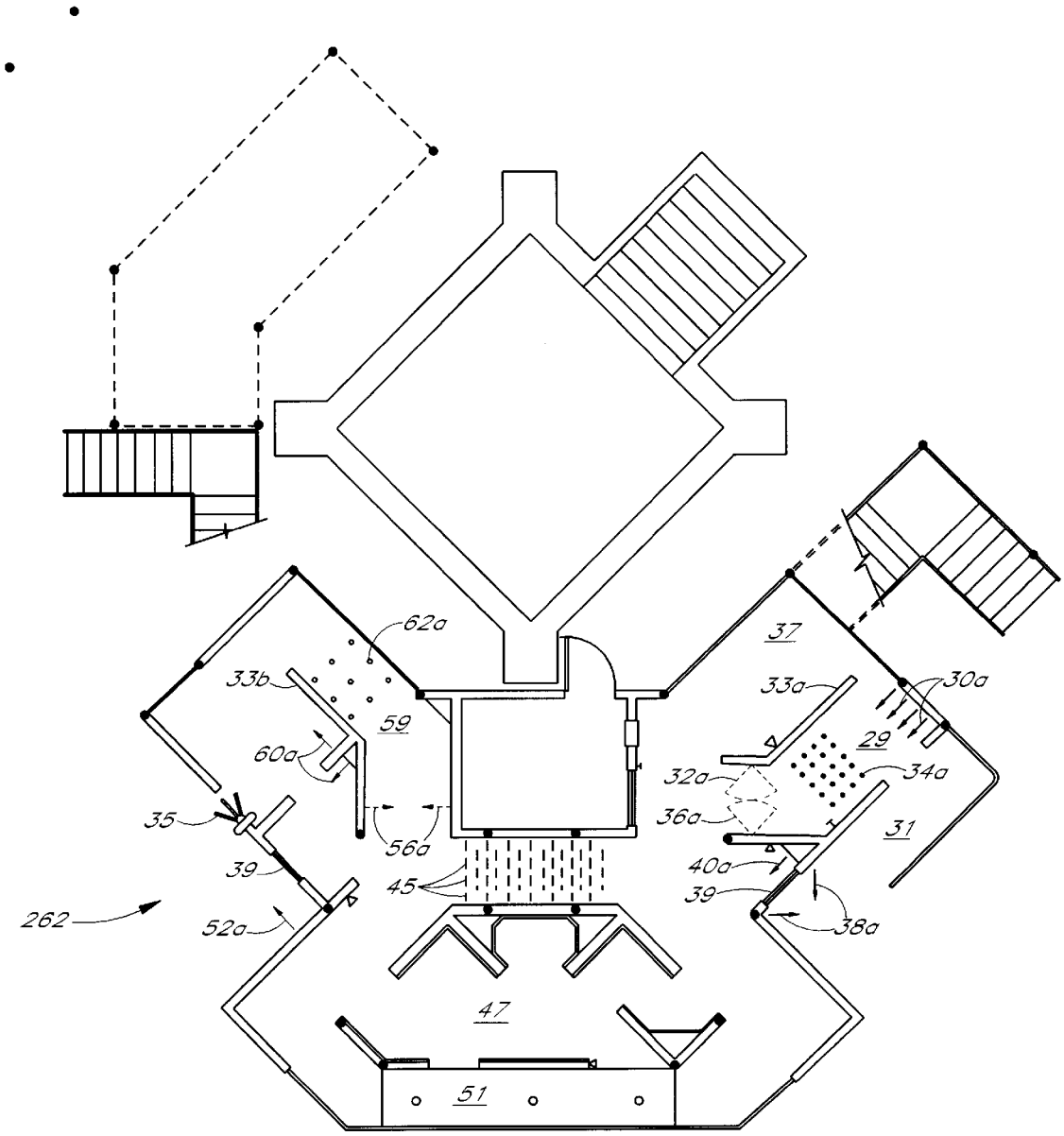
FIG. 3 is a ground level plan of the interactive water play structure of FIG. 1 indicating one preferred layout including location and orientation of various interactive play elements.
Figure 4:
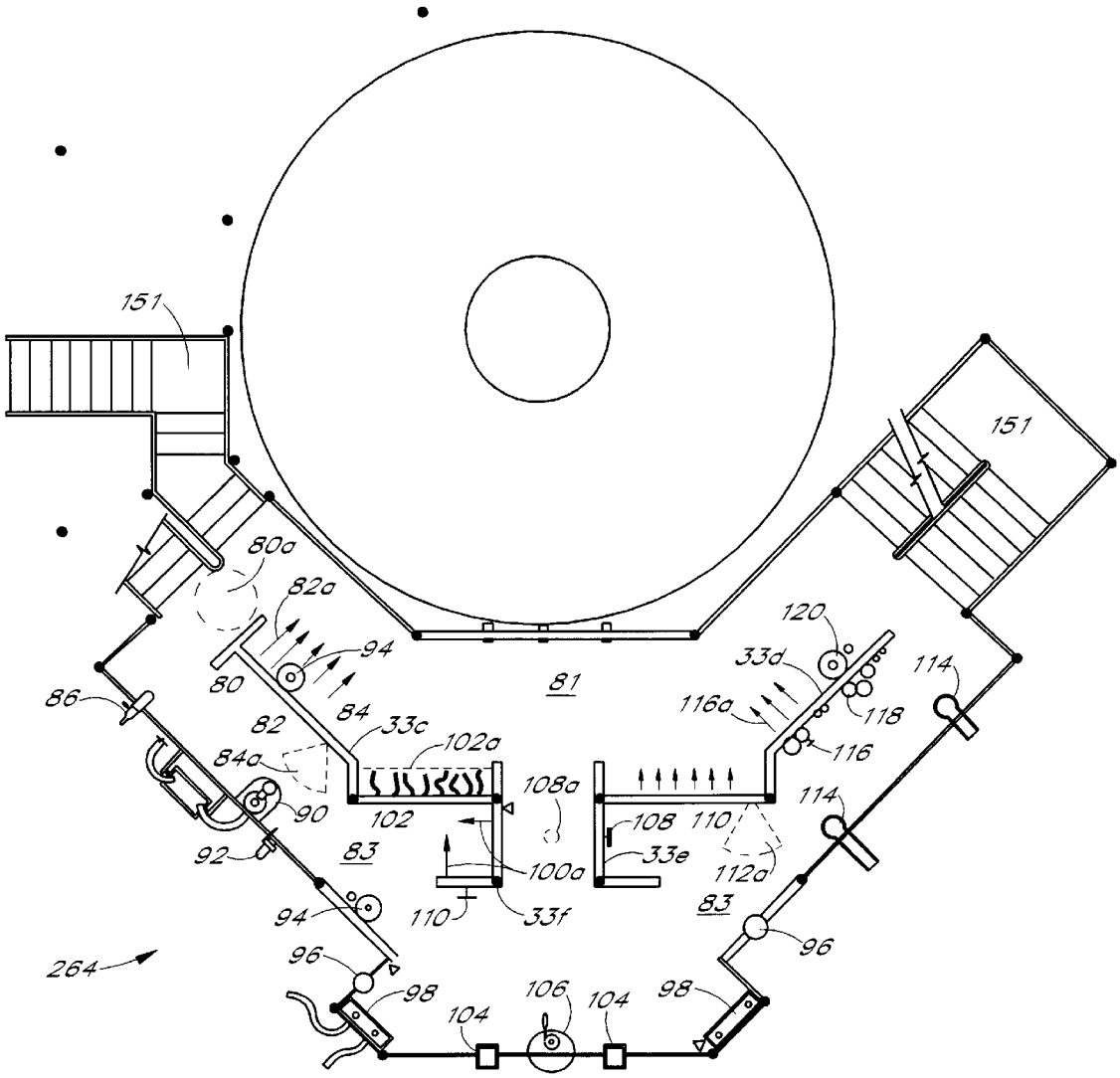
FIG. 4 is a second level plan of the interactive water play structure of FIG. 1 indicating one preferred layout including location and orientation of various interactive play elements.
Figure 5:
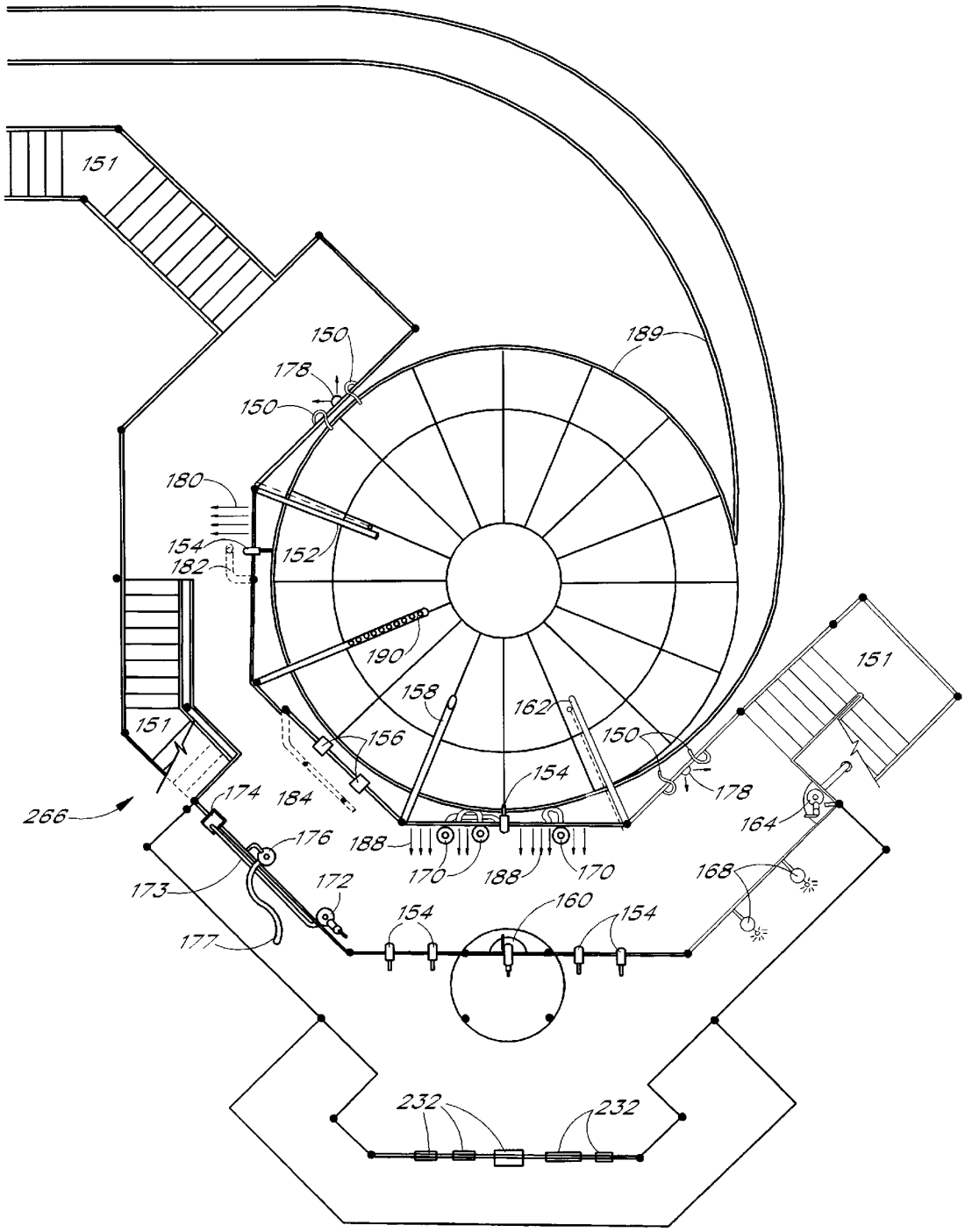
FIG. 5 is a top level plan of the interactive water play structure of FIG. 1 indicating one preferred layout including location and orientation of various interactive play elements, including play elements that interact with an adjacent water slide.

FIGS. 3–5 are preferred plan views of three levels of the embodiment shown in FIG. 1. These figures show specific preferred locations and paths for accessing and operating various preferred play elements and effects. Of course, it will be appreciated by those skilled in the art that many combinations of water, air and/or other effects and path layouts are possible.

FIG. 3 is a plan view of the ground level 262 of the embodiment shown in FIG. 1. As play participants approach the entrance 31 of the structure, they will notice a mirror 39 on their left. This is a one-way mirror. As a participant on the outside of the structure examines his reflection in the mirror, a participant at position 38 may activate a valve which sprays jets of water 38*a* on the unsuspecting mirror-watcher. As participants enter the structure, they find themselves in the opening hallway 29. Here they may be barraged with water jets 30*a* from behind and bubbler jets 34*a* from the floor. These water effects are controlled by other play participants standing at positions 30 and 34, respectively, in a hidden room 37 behind a wall 33*a*. The wall 33*a* has holes enabling the attackers to see their victims. In the opening hallway 29 participants may find a button 40 that, when pushed, sprays a jet of water at position 38, where the water jets 38*a* by the one-way mirror 39 are controlled. As participants make their way out of the opening hall 29, they may be hit with misting sprays 32*a*, 36*a* operated by participants standing at locations 32 and 36, respectively.

Once through the opening hall 29, participants may enter room 37 and man positions 30, 32 and 34, where they can now control the water effects that just sprayed them. Having been the victim, participants may now play the role of attacker and spray the next group to enter the structure. Participants may also man position 36, which controls a misting spray 36a that sprays in the opening hall 29, or they may man position 38, where they may operate the sprayers 38a adjacent the one-way mirror 39.

Also available are play elements 42 and 44, which affect only the individual operating the effect. For example, play element 42 appears to be a simple mirror but is actually a one-way mirror 39. When an adjacent button is pressed, a light behind the one-way mirror 39 is turned on, exposing a graphic of an evil clown or other surprising graphic, with or without accompanying sound effects. Position 44 is a gag box. This may be an odd-shaped box with a door which, when opened, actuates a valve. When the door to this gag box 44 is opened, jets spray the participant who opened the door.

Participants next have a number of options as to what path to pursue. One option is to walk through a hallway of oozing slime flaps 46. This effect is created by running yellow-green colored water down a series of thin plastic flaps 45. The flaps 45 are hanging from the ceiling and participants must push their way through them to get through the hallway 46. The plastic flaps 45 may be affixed to the hallway ceiling by any number of suitable methods known in the art. Similarly, the supply of water on the flaps may be delivered by any number of suitable methods known in the art.

Another option for participants is the mirror room 47, which is filled with image-distorting mirrors. The mirror room 47 also includes the effect of a slime mirror 48. Yellow-green water is run from the top of the slime mirror 48 to give the slime effect.

Another option for participants is to travel over a grate 51 that is suspended over a pool of yellow-green water. Geysers 50 using the yellow-green water of the pool periodically actuate and extend through the grate 51 and participants must gingerly work their way around or through them to proceed to the end of the grate 51 without getting hit by slime water.

After their experience with slime, participants once again have a number of options. Participants can proceed to position 52, where they man another one-way mirror 39 and can control an effect that shoots a water spray 52*a* on participants who may be outside of the structure looking at their reflection in that mirror.

At position 56, participants can activate a play element that shoots jets of air 56*a* at participants that are making their way down an adjacent hallway 59. However, position 59 is vulnerable, because participants in the hallway 59 can also activate a valve 60 to shoot a stream of water 60*a* at the participant manning position 56. Position 60 also enables shooting a stream of water 60*a* at position 62, which controls floor sprays 62*a* to surprise participants in the hallway 59. Hallway 59 also contains a gag box 58. When the door of this gag box 58 is opened, water is dumped from above onto the participant.

Figure 9:
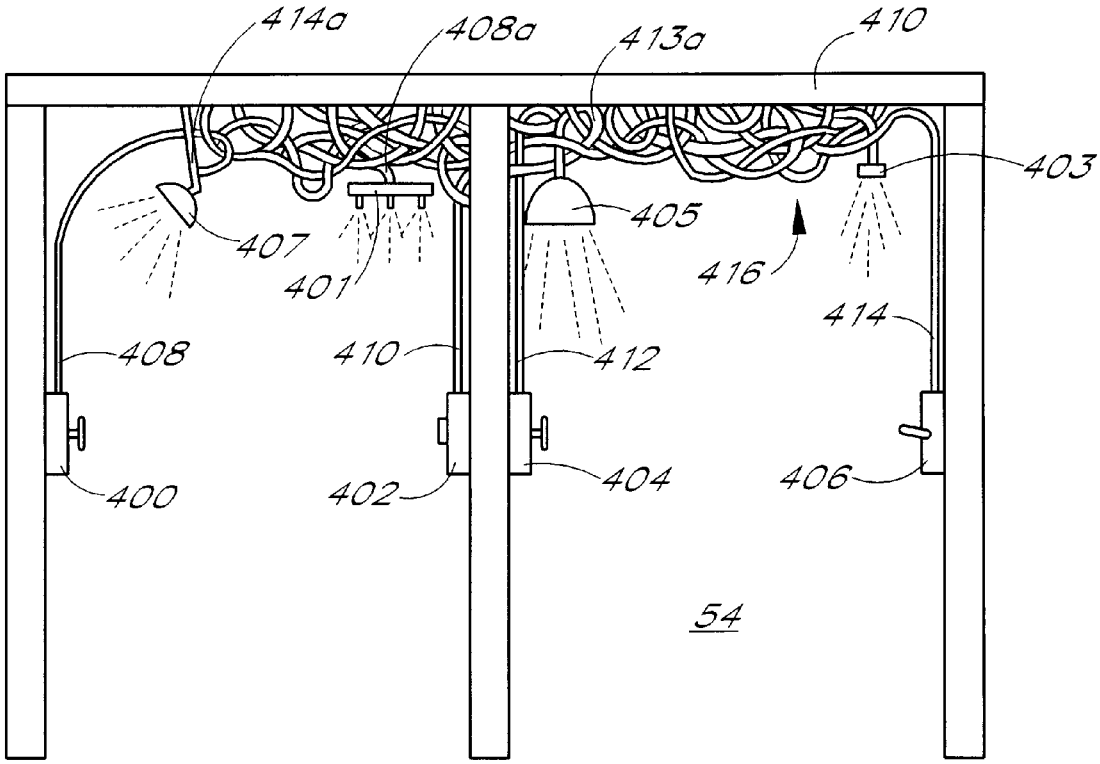
FIG. 9 shows a side elevation view of a hose room having features in accordance with the present invention.

An optional hose room 54 is best shown in FIG. 9. A number of valves 400, 402, 404, 406 are provided, each valve 400, 402, 404, 406 being painted a different color. The valves 400, 402, 404, 406 are connected to hoses 408, 410, 412, 414 of the same or similar color, which hoses 408, 410, 412, 414 proceed directly overhead. The ceiling of the hose room 54 consists of a maze 416 of colored hoses intertwined in every which direction. Somewhere along the way, each hose line 408, 410, 412, 414 changes colors. Each of these new-colored hoses 408*a*, 410*a*, 412*a*, 414*a* then connects to a water effect 401, 403, 405, 407 such as a shower or spout, which is painted to match the current color of its connecting hose 408*a*, 410*a*, 412*a*, 414*a*. Thus, the blue valve 400 may actually activate the green shower 401, and so on. Play participants will be entertained as they try to figure out which valve 400, 402, 404, 406 activates which water effect 401, 403, 405, 407. If desired, the hose room 54 may contain one or more other effects such as gag box 57 which, when opened, shoots a stream of water at the participant's mid-section.

Once they complete the ground level 262, participants may leave the level via the exit 35.

FIG. 4 shows the second level 264 of the embodiment of FIG. 1. This level is accessible on either side by stairs 151. As participants enter this level, they may find themselves doused by an overhead cone spray of water 80*a*, which is controlled by a participant hidden behind a wall at position 80. As participants proceed further, they find a funnel bomber 94. This play element is a funnel mounted in the floor and having a faucet positioned above it. A ball on a chain is used to selectively plug or unplug the funnel. When the funnel is filled with water, the plug is pulled and the water bombs or pours out onto participants below on the ground floor 262. However, participants using the funnel bomber 94 may be surprised when jets of water suddenly spray their feet. These floor jets 82a are controlled by another participant hiding behind a wall 33c at position 82. At position 84, participants may control a mist sprayer 84*a* which sprays participants on the other side of the wall 33*c*.

As participants proceed down the back corridor 81, they encounter a spraying hose wall 102*a*. This effect is controlled by a participant at position 102 and consists of a wall full of small, thin hoses which, when turned on, spray water every which way. The hoses are not restrained at their ends, so they flip about as water pressure dictates. A mesh net is preferably provided to prevent participants from grasping the hoses.

If participants attempt to go between the back corridor 81 and the front 83, they may encounter a swivel spray 108*a* that douses them from above. The swivel spray 108*a* consists of a shower nozzle that can be swung 90 degrees and is controlled at position 108 behind a wall 33*e*.

Continuing down the back corridor 81 participants come across an air wall 110*a*. The air wall 100*a* consists of a number of air jets that blow pressurized air at participants. The air wall 110*a* is controlled at position 110 behind the wall 33*d*. Next to the air wall 110*a* is position 112. At this position, play participants can control a mist sprayer 112*a* to spray participants on the other side of the wall 33*d*. As participants proceed, they may also be sprayed by arch jets 116*a*. Again, these jets are controlled from behind the wall 33*d* at position 116. Next is another funnel bomber 120 through which participants can dump water on participants below.

Around the corner to the front 83 is slime piping 118. This play element consists of clear or translucent pipes that are arranged to look as though they are carrying yellow-green slime. The walls 33*d*, 33*e* in the front 83 contains the control positions to many play elements whose effects are actually experienced in the back corridor 83. These control positions include the arch jets 116, air wall 110, swivel sprayer 108, hose wall 102, foot jets 82 and the overhead cone spray 80. The mist sprayers 84*a*, 112*a* are controlled in the back corridor 81 at positions 84 and 112, but the spray effects are in the front 83. The wall 33*f* in the front 83 also has a play element enabling a participant at position 100 to push a button to shoot jets 100*a* at the participant manning the hose wall control position 102.

Along the front 83 are a number of other play elements. For example, tipping troughs 114 allow participants to pour water on other participants below. A funnel bomber 94, dumping buckets 96 and tipping trays 104 similarly enable participants to bomb water on those on the ground level 262. The double sinks 98 require participants to fill a sink 98 with water. Then the participants can open one of the drains of the sink. Pipes are connected to each of the drains and lead to different points. By choosing which of the drains to unplug, the participants dictate which of the pipes will dump the water and where. This play element is illustrated in more detail in FIGS. 8*a* and 8*b*, discussed later. A spout 92 mounted on the rail 240 enables easy spraying of victims below. A water gun 86 enables participants to spray participants below and near the structure 218.

A pump gun 106 requires participants to fill a trough with water. They can then use the pump gun 106 to shoot that water. This particular pump gun 106 is aimed vertically. FIG. 2 shows that this pump gun 106 shoots water vertically to activate a rotating target 230. The target 230 rotates when hit with water from the pump gun 106. A similar pump gun is illustrated in more detail in FIG. 7, discussed later.

A basket dump 88 consists of a large rectangular trough that may be filled with water and is mounted so that it may be tipped, dumping the water on participants below. It is filled by means of a funnel and pump 90. Participants use the pump to pump water into the funnel. From the funnel, the water runs through a pipe to fill the basket 88. If desired, the basket dump 88 can also be filled by way of a spout descending from the top level 266.

FIG. 5 shows the top level 266 of the embodiment of FIG. 1. This level has a number of play elements that allow interaction with the other levels 262, 264 and with participants on an adjacent play structure, in this case a water slide 189. Those skilled in the art will appreciate that the adjacent play structure could be in nearly any shape or variety, such as another participatory water play structure or even a play river or stream.

Play participants can directly spray participants on the adjacent water slide 189 with rail hoses 150 and compression guns 154. Compression guns 154 require participants to draw water into the gun by pulling back on the handle. As the participant then pushes the handle, the water is forced out through a nozzle, resulting in a shooting stream. A pull rope spout 152 hangs over the water slide 189. When a participant on the top level 266 pulls a rope, water pours out of the spout 152 onto the water slide 189 and, if the timing is right, onto the water slide participant. Similarly, a shower 162 which hangs over the water slide 189 is activated by a pull rope. Participants on the top level 266 can also activate a pipe falls 158 which pours water out of a pipe that is hanging over the water slide 189.

A number of other effects can be activated by participants on the water slide 189, to target or fight back against participants on the play structure 218. These effects may be activated, for example, when water slide participants touch various sensors on the slide. Alternatively, buttons on the slide could also be used. These effects may include, for example and without limitation, angled sprayers 178; railing jets 180, 188 that spurt out of the railing 240 onto unsuspecting play participants; an overhead sprayer 182; an overhead spout 184; and bar jets 190.

A tipping tray 174 allows participants to dump water on participants below the top level. But the tipping tray 174 must first be filled by pumping water into a funnel 172 that is connected to a pipe 173. The water flows into the funnel 172 and through the pipe 173, filling the tipping tray 174. Another funnel 176 enables participants on this top level 264 to help fill the basket dump 88 on the second level 264. The funnel 176 is connected by a pipe 177 to a spout that empties into the basket dump 88. A hand pump and funnel assembly 164 allows play participants to dump water onto participants that may be climbing the stairs 151. Additional funnel bombers 170 enable play participants to dump water onto the second level 264. Play elements 168 entail plastic balloons with long fingers that have holes in their ends. As the balloons are filled, water sprays out of the finger holes.

A pump gun 160 and compression guns 154 are mounted on the railing 240. They can be used to spray other participants, but are especially situated for aiming at and spraying the letters 232 in the "FUNHOUSE" sign. When hit by water from a gun 154, 160, these letters 232 will flip 180 degrees or spin. FIG. 2 also shows a clear view of these their guns 154, 160 and their interaction with the letters 232 of the "FUNHOUSE" sign. Those skilled in the art will appreciate that any variety of guns could be used in place of the pump gun 160 or compression guns 154, including water hose guns or ball or projectile launchers, as desired.

The following FIGS. 6–9 show in more detail some of the various interactive participatory play elements that may be used in an interactive water play structure constructed in accordance with the present invention. The drawings and descriptions are provided only as examples of the types of participatory water play elements that may be used to practice the present invention, and should not be construed as limiting in any way the scope of the claimed invention.

Figure 6A:
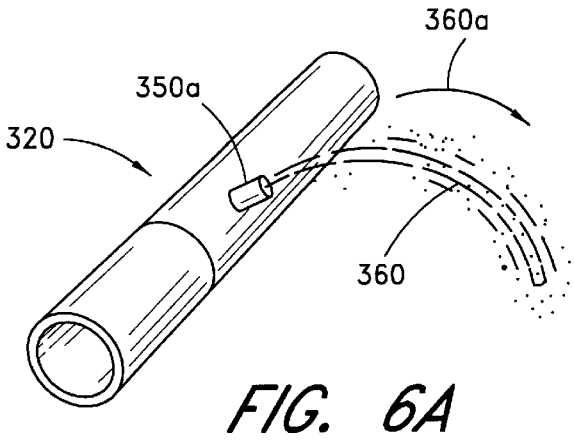
FIG. 6*a* shows a perspective view of an external nipple nozzle angled at 45 degrees from the horizontal to form an arch jet.
Figure 6B:
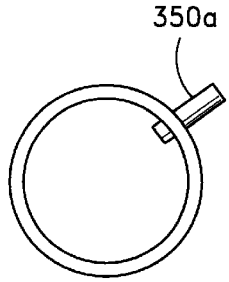
FIG. 6*b* is a cross-section of the external nipple nozzle of FIG. 6*a;*

FIG. 6*a* through FIG. 6*v* show representative water forming devices and their associated kinetic water effects. Starting with FIG. 6*a* (perspective view) and FIG. 6*b* (cross-section of 6*a*) there is detailed external nipple nozzle 320 comprised of an external nipple 350*a* which is secured by glue, thread or weld. Jet 360 water effect issues from external nipple nozzle 320.

Figure 6C:
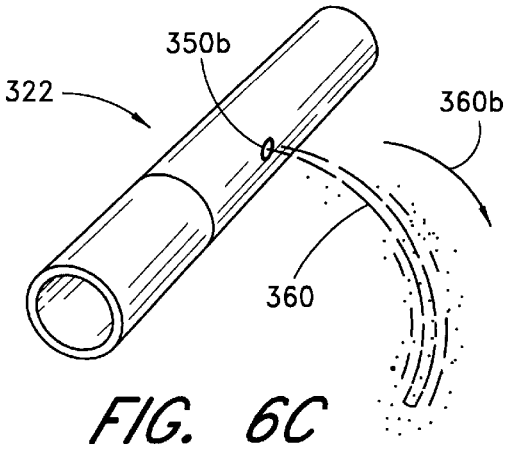
FIG. 6*c* shows a perspective view of an internal nipple nozzle aimed horizontally to form an angle jet.
Figure 6D:
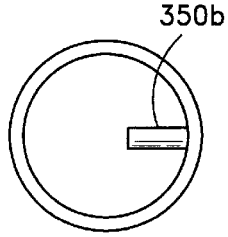
FIG. 6*d* is a cross-section of the internal nipple nozzle of FIG. 6*c;*

FIG. 6*c* (perspective view) and FIG. 6*d* (cross-section of 6*c*) show an internal nipple nozzle 322 which is similar to external nipple nozzle 320 except that internal nipple 350*b* is oriented inward and flush to the outside of the nozzle, with the outside surface made smooth so that external appearance is simply of a hole. Internal nipple nozzles 322 are used for purposes of safety, especially in the regions of the water play structure 218 where participants could make contact with external nipples. External nipple nozzle 320 and internal nipple nozzle 322 produce similar jet 360 water effects, with external nipple nozzle 320 producing a jet 360 with a slightly smoother rod-like surface.

Figure 6E:
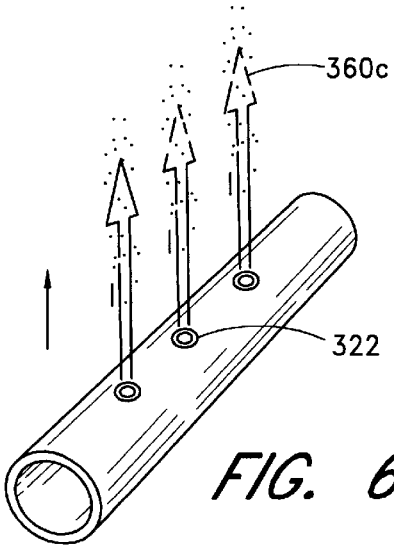
FIG. 6*e* shows a series of vertical jets produced when nipple nozzles are directed vertically.
Figure 6F:
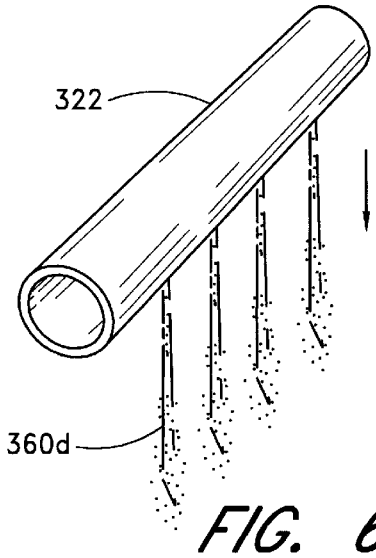
FIG. 6*f* shows a series of bar jets produced when nipple nozzles are directed downwardly.
Figure 6G:
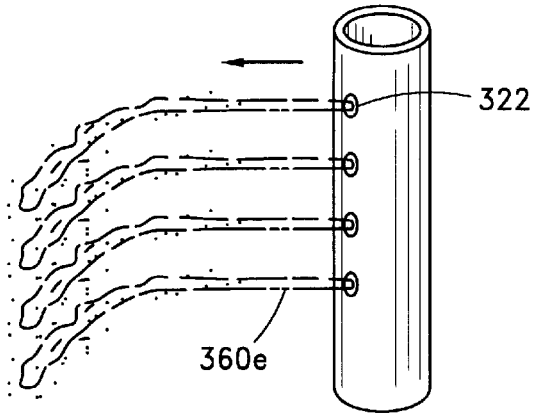
FIG. 6*g* shows a series of horizontal jets created when nipple nozzles are oriented one-on-top-of-the-other along the vertical axis.
Figure 6H:
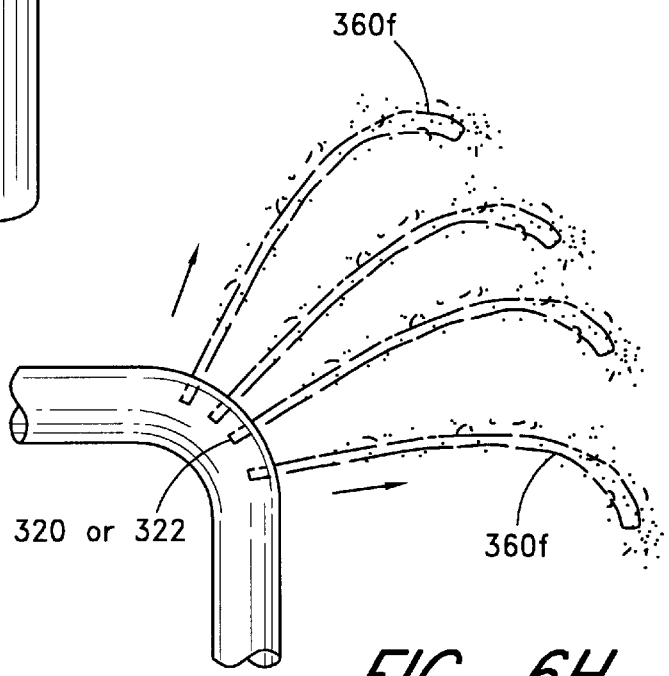
FIG. 6*h* shows a series of peacock jets created when nipple nozzles are linearly oriented around a curved conduit.

The orientation of nipple nozzles 320 and 322 relative to the force of gravity produces identifiably different jet water effects. FIG. 6*a* shows an arch jet 360*a* formed when nipple nozzle 320 is directed at a 45 degree angle from the vertical. FIG. 6c shows an angle jet 360*b* formed when nipple nozzle 322 is directed at a 90 degree angle from the vertical. FIG. 6*e* shows a series of vertical jets 360*c* produced when nipple nozzles 322 are directed vertically. FIG. 6*f* shows a series of bar jets 360*d* produced when nipple nozzles are directed downwardly. FIG. 6*g* shows a series of horizontal jets 360*e* created when nipple nozzles 322 are oriented one-on-top-of-the-other along the vertical axis. FIG. 6*h* shows a series of peacock jets 360*f* created when nipple nozzles 320, 322 are linearly oriented around a curve.

Figure 6I:
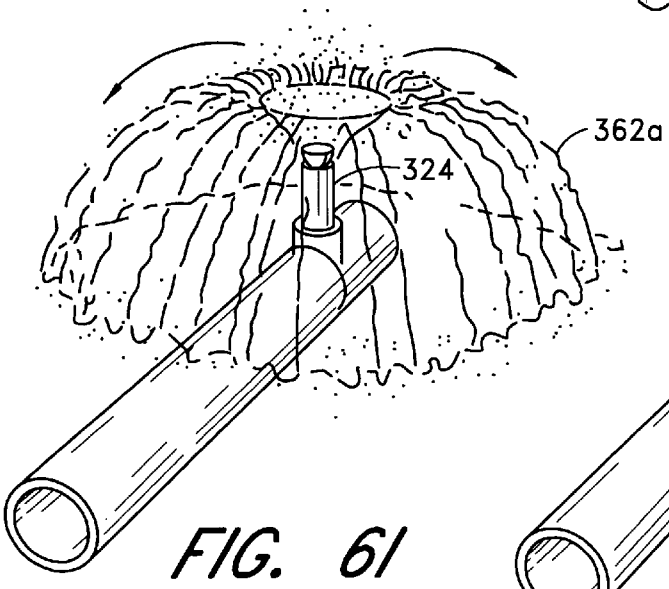
FIG. 6*i* shows a cone nozzle producing an umbrella spray.
Figure 6J:
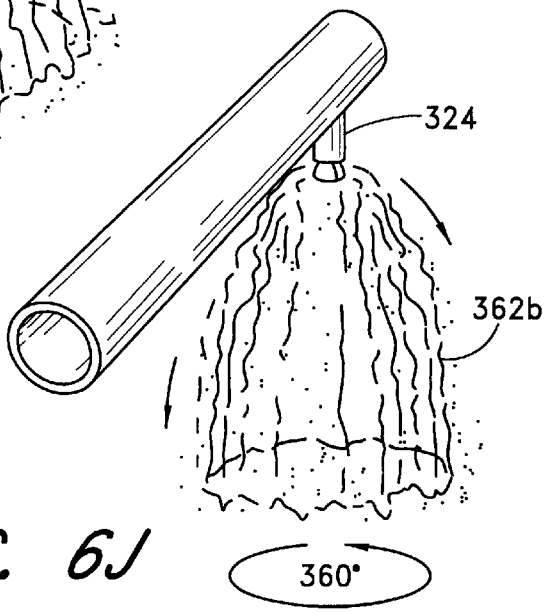
FIG. 6*j* shows a cone nozzle producing a cone spray.

FIG. 6*i* shows cone nozzle 324. When oriented with cone nozzle 324 pointed predominantly vertically cone nozzle 324 produces an umbrella spray 362*a*.FIG. 6*j* shows cone nozzle 324 pointed in a predominantly downward direction and forming a cone spray 362*b*.

FIG. 6*k* shows a water gun nozzle 326. A trigger 327 opens a valve within the water gun, releasing water which forms a water gun jet 364.

FIG. 6*l* shows geyser nozzle 328 forming a geyser 366. In order for geyser 366 to properly form, geyser nozzle 328 must be positioned under a few inches of water and oriented towards the vertical.

FIG. 6*m* shows platform nozzle 330 comprised of external nipple nozzle 320 vertically positioned with nozzle opening flush with an opening through floor platform 352. Platform nozzle 330 forms a platform spout 368 water effect.

FIG. 6*n* shows mist nozzle 332 issuing a mist 370 water effect.

Figure 6O:
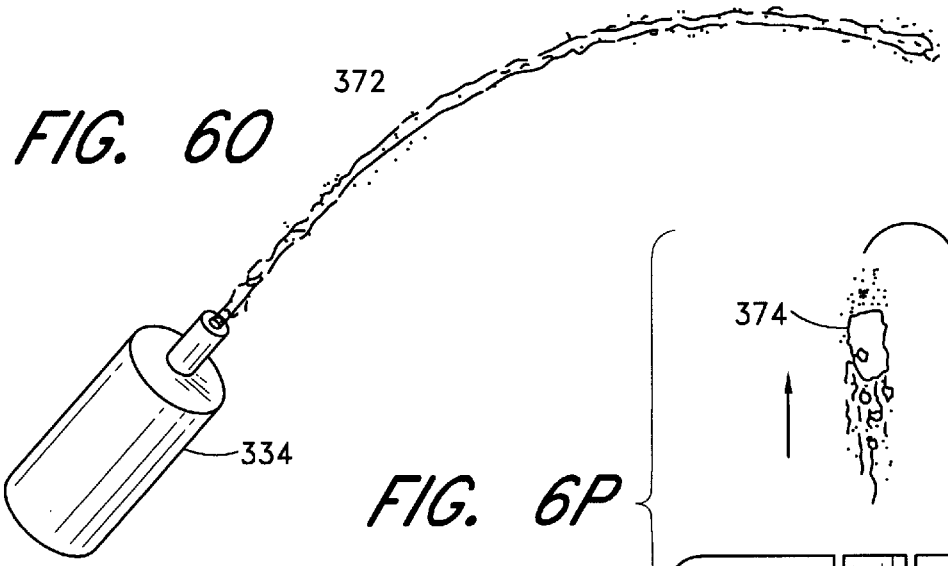
FIG. 6*o* shows a laminar flow nozzle generating a laminar flow.

FIG. 6*o* shows laminar flow nozzle 334 issuing a laminar flow 372 water effect. Laminar flow 372 differs from a normal jet in that the water is uni-directional and non-turbulent.

Figure 6P:
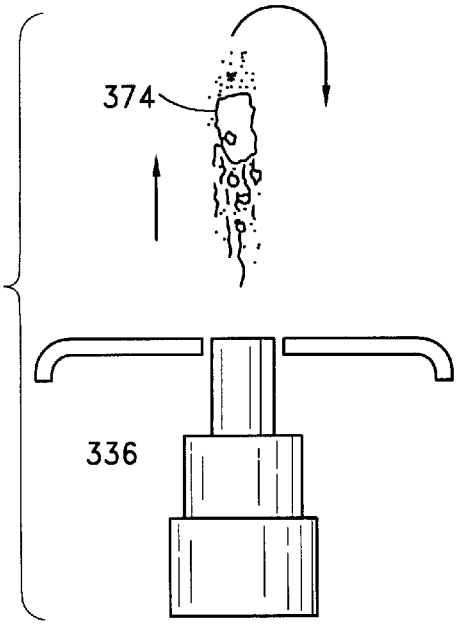
FIG. 6*p* shows a water ball nozzle shooting a water ball.

FIG. 6*p* shows jumping water ball nozzle 336 issuing a jumping water ball 374 water effect. This effect is especially effect as an effect coming from a floor.

Figure 6Q:
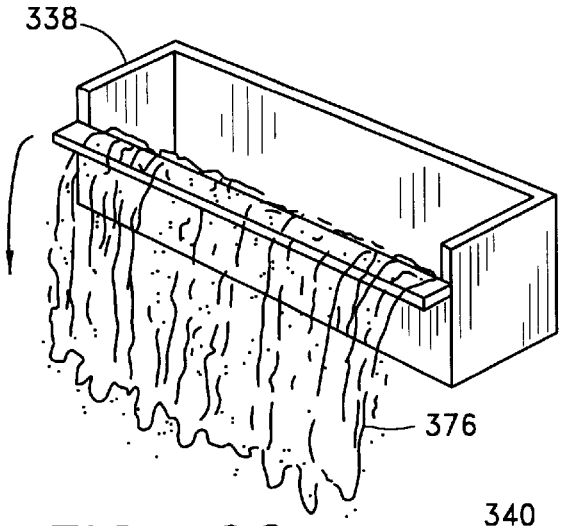
FIG. 6*q* shows a curtain water fall weir creating a curtain water fall.

FIG. 6*q* shows curtain water fall weir 338 creating a curtain water fall 376.

Figure 6R:
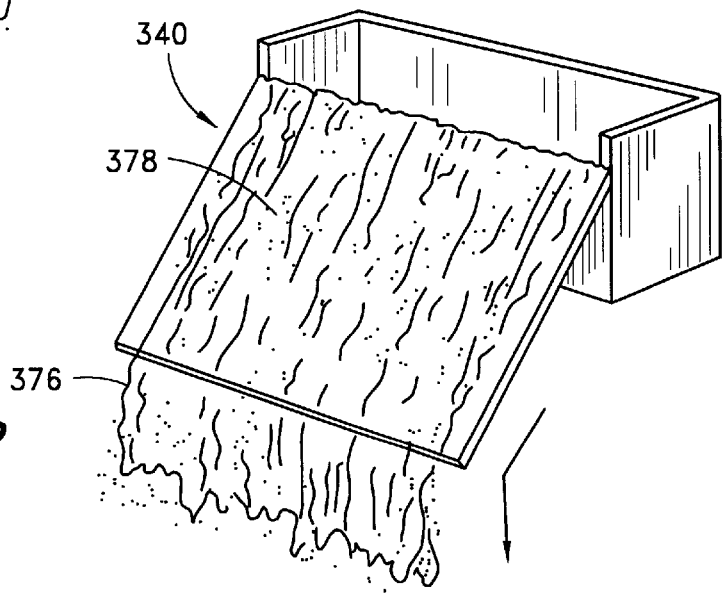
FIG. 6*r* shows a weir with inclined surface creating an inclined surface sheet with subsequent curtain water fall.

FIG. 6*r* shows weir with inclined surface 340 creating an inclined surface sheet 378 with subsequent curtain water fall 376.

FIG. 6*s* shows rake water fall weir 342 forming a rake water fall 380.

FIG. 6*t* shows open pipe aperture 344 forming a non-pressurized gravity pour 384 water effect.

FIG. 6*u* shows a pool and runnel aperture 346 making a pond/stream/fall combination 382 water effect.

FIG. 6*v* shows connected bucket aperture 348 filling a bucket 354 which, when tipped (as indicated by dotted lines) produces a bucket dump 386 water effect. This effect can be expanded, using a large basket in place of the bucket 354.

Figure 7:
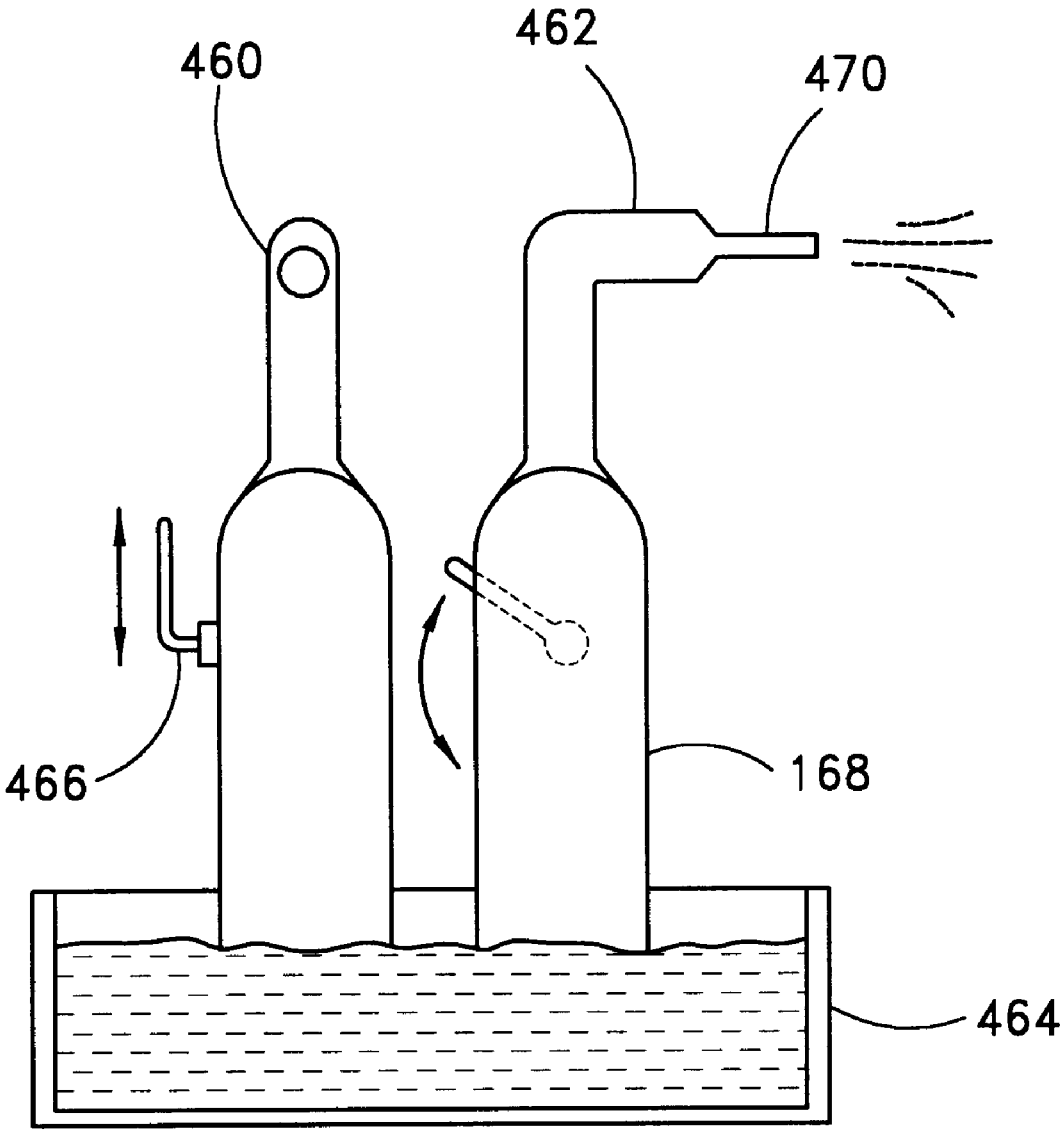
FIG. 7 shows a pair of pump guns having features in accordance with the present invention.

FIG. 7 shows a pair of pump guns 460, 462. One pump gun 460 is directed outwardly. The other pump gun 462 is directed to the side. The pump guns 460, 462 allow play participants to pump water from a pump basin 464 to form a stream of water which my be directed onto other play participants or other targets, such as the rotating "FUN-HOUSE" letters 232 or rotating target 230 shown in FIGS. 1 and 2.

Each of the guns 460, 462 is activated by a hand-actuated lever 466 which may be manipulated by play participants to operate a pump (not shown) disposed within a pump gun housing 468. The pump may be of any one of a number of positive displacement type pumps well known in the art. It will be appreciated by those skilled in the art that the pump syphons water from the basin 464 and sprays it out of a water gun nozzle 470, as shown. The water gun nozzle 470 can be built to shoot in any direction, including straight up. In this figure, the nozzles 470 are built to shoot horizontally.

Before the pump guns 460, 462 can be activated, however, it is first necessary to provide the guns with "ammunition" by filling the pump basin 464 with water. Those skilled in the art will appreciate that any number of water effects, such as a spray nozzle, archimedes screw, or rotatable trough may be used to supply the pump guns 460, 462 with water.

Figure 8A:
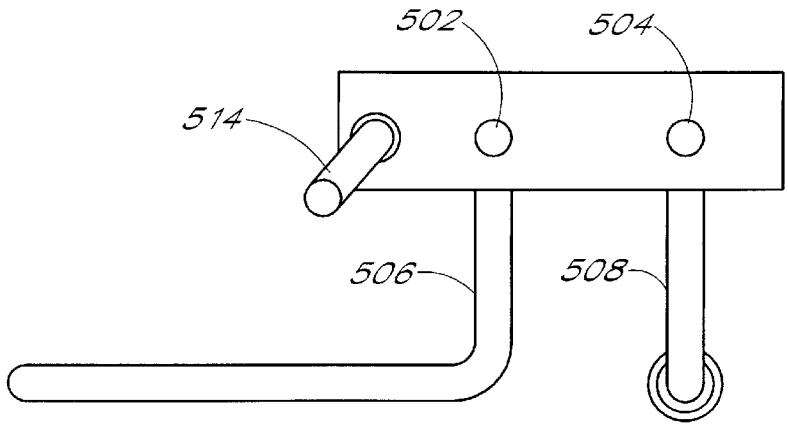
FIG. 8*a* shows a top plan view of a play sink having multiple outlets.
Figure 8B:
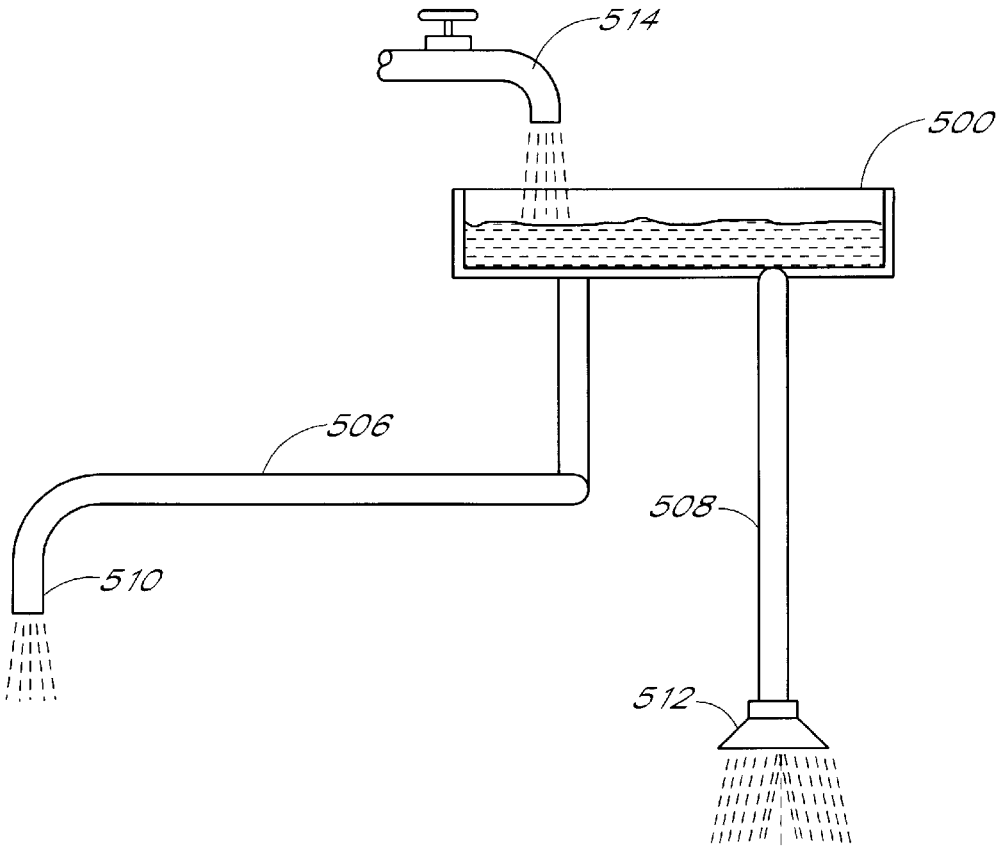
FIG. 8*b* shows a front partial cross-section view of the play sink of FIG. 8*a*.

FIGS. 8*a* and 8*b* show plan and front elevational views, respectively, of a play sink 500 having multiple outlets 502, 504, one or both of which may be closed or plugged. Water from an adjacent water effect 514 fills the sink basin 500. The sink 500 continues to fill with water until it either overflows or until a play participant unplugs one or both of the outlets 502, 504. Unplugging any of the outlets 502, 504 causes the water to exit through a corresponding pipe 506, 508 located beneath the sink 500. These pipes 506, 508 are configured to deliver the sink water to shower heads 510, 512, respectively, which are located in other, possibly remote, areas of the play structure. This allows play participants to mount surprise attacks on other play participants, since victims caught standing underneath the shower heads 510, 512 will not know where the water came from or who caused it to be delivered.

What is claimed is:

1. A delayed water effect for entertaining play participants, said water effect comprising:

a model of a structure that typically holds liquid;

a leak system comprising:

a plurality of pipes, nozzles and valves installed in or around said model such that when said valves are actuated water flows through said nozzles, simulating leaks emanating from said model;

a burst system comprising:

a plurality of pipes, nozzles and valves installed in or around said model of size such that when said valves are actuated water flows through said nozzles in sufficient volumes to simulate a burst of said model;

means for operating said pipes, nozzles and valves;

wherein said valves are progressively actuated in said leak system and then all of said valves to said burst system are actuated concurrently, producing a leak-to-burst effect.

2. A delayed water effect in accordance with claim 1 wherein said model simulates a boiler, dam, vat, tank or nuclear reactor.

3. A delayed water effect in accordance with claim 1 including a timer, and wherein said leak-to-burst effect is adapted to repeat in accordance with said timer.

4. A delayed water effect in accordance with claim 1 including a trigger mechanism, and wherein said trigger mechanism is adapted to actuate said leak-to-burst effect at intermittent unpredictable intervals.

5. A delayed water effect in accordance with claim 1 including a trigger mechanism adapted to start said leak-to-burst effect when the trigger is actuated, and wherein actuation of said trigger mechanism can be hastened or delayed by the actions of play participants.

6. A delayed water effect in accordance with claim 5, wherein play participants can hasten actuation of the trigger mechanism by operating a trigger-hastening pump.

7. A delayed water effect in accordance with claim 5, wherein play participants can delay or hasten actuation of the trigger mechanism by actuating specified trigger-affecting valves.

8. A delayed water effect in accordance with claim 1 further comprising means to display the status of said leak-to-burst effect.

9. A delayed water effect in accordance with claim 1 further comprising sound or vibration effects.

10. A delayed water effect for entertaining play participants, said water effect comprising a plurality of models of structures that typically hold liquid, each of said models comprising:

a leak system comprising:

a plurality of pipes, nozzles and valves installed in or around said model such that when said valves are actuated water flows through said nozzles, simulating leaks emanating from said model;

a burst system comprising:

a plurality of pipes, nozzles and valves installed in or around said model of size such that when said valves are actuated water flows through said nozzles in sufficient volumes to simulate a burst of said model;

means for supplying water to all of said pipes and nozzles; and means for operating said pipes, nozzles and valves;

trigger means that will determine when operate individual members of said leak and burst systems;

wherein said valves are progressively actuated in said leak system and then all of said valves to said burst system are actuated concurrently, producing a leak-to-burst effect.

11. A delayed water effect in accordance with claim 10 wherein each of said models is adapted to perform said leak-to-burst effect concurrently with others of said models.

12. A delayed water effect in accordance with claim 10 wherein each of said models performs said leak-to-burst effect independent of any other of said models.

13. An interactive funhouse play structure for entertaining play participants, said play structure comprising:

a support structure constructed in the theme of a carnival funhouse;

a conduit system associated with said support structure for supplying air from a pressurized source;

a source of pressurized air;

at least one air play element disposed on said support structure;

a conduit system associated with said support structure for supplying water from a pressurized source;

a source of pressurized water;

a path defined by said play structure through which play participants traverse;

a play element disposed on said support structure and adapted to create a desired effect upon a first play participant; and an actuator and controller for allowing a second play participant to operate said play element;

wherein said controller is positioned such that the first play participant cannot readily determine that the second play participant is responsible for creating the effect experienced by the first play participant.

14. An interactive funhouse play structure for entertaining play participants, said play structure comprising:

a support structure constructed in the theme of a carnival funhouse;

a mirror room play element;

a conduit system associated with said support structure for supplying water from a pressurized source;

a source of pressurized water;

a path defined by said play structure through which play participants traverse;

a play element disposed on said support structure and adapted to create a desired effect upon a first play participant; and an actuator and controller for allowing a second play participant to operate said play element;

wherein said controller is positioned such that the first play participant cannot readily determine that the second play participant is responsible for creating the effect experienced by the first play participant.

15. A play structure in accordance with claim 14 further comprising:

a conduit system associated with the support structure for supplying air from a pressurized source; and at least one air play element disposed on said support structure.

16. An interactive funhouse play structure for entertaining play participants, said play structure comprising:

a support structure constructed in the theme of a carnival funhouse;

a conduit system associated with said support structure for supplying water from a pressurized source;

a source of pressurized water;

a gag box play element;

a path defined by said play structure through which play participants traverse;

a play element disposed on said support structure and adapted to create a desired effect upon a first play participant; and an actuator and controller for allowing a second play participant to operate said play element;

wherein said controller is positioned such that the first play participant cannot readily determine that the second play participant is responsible for creating the effect experienced by the first play participant.

17. A play structure in accordance with claim 16 wherein said gag box comprises:

a one-way mirror;

a graphic effect disposed behind said one-way mirror so as to be hidden from a play participant looking into the mirror;

means for illuminating said graphic; and means for energizing said means for illuminating said graphic;

wherein a play participant may cause the graphic to be illuminated, thereby causing the graphic to be visible through said one-way mirror.

18. A play structure in accordance with claim 16, wherein the gag box comprises:

a door;

a valve;

a gag box water forming element in communication with the valve; and an actuator adapted to actuate the valve when the door is opened.

19. A play structure in accordance with claim 18, wherein the gag box water forming element is adapted to direct water at a position immediately adjacent the door.

20. A play structure in accordance with claim 16, further comprising:

a conduit system associated with said support structure for supplying air from a pressurized source; and at least one air play element disposed on said support structure.

21. A method of entertaining play participants by creating a leak-to-burst water effect, said method comprising the steps of:

providing a model of a structure that typically holds liquid;

providing a leak system comprising:

a plurality of pipes, nozzles and valves installed in or around said model such that when said valves are actuated water flows through said nozzles, simulating leaks emanating from said model;

providing a burst system comprising:

a plurality of pipes, nozzles and valves installed in or around said model of size such that when said valves are actuated water flows through said nozzles in sufficient volumes to simulate a burst of said model;

providing means for operating said pipes, nozzles and valves;

progressively actuating said valves in said leak system; and concurrently actuating all of said valves to said burst system.

22. A play element comprising:

a support structure;

a plurality of valves disposed on said support structure;

hoses connected to individuals of said valves and colored initially to match the color pattern of the valve to which each of said individual hoses is connected, each of said hoses extending into and out of an intertwining area, said intertwining area comprising:

a plurality of hoses, all of said hoses being intertwined with each other and the color pattern of at least one of said hoses varying along the length of the hose so as to no longer match the color pattern of the valve to which it is connected;

said hoses extending from said intertwining area to connect to nozzles, each of said nozzles colored to match the color pattern of the hose to which said nozzle is connected;

wherein actuation of an individual of said valves with a particular color pattern will cause water to flow through an individual of said hoses and emanate from a nozzle whose color pattern does not necessarily match the color pattern of said individual valve.

* * * * *